US005516594A

United States Patent [19]

Hasegawa

[11] Patent Number: 5,516,594

[45] Date of Patent: May 14, 1996

[54] NI-SN PLATED FASTENERS FOR CLOTHING

[75] Inventor: Kenji Hasegawa, Tokyo, Japan

[73] Assignee: Scovill Japan Kabushiki Kaisha, Tokyo, Japan

[21] Appl. No.: 309,666

[22] Filed: Sep. 21, 1994

[51] Int. Cl.[6] ..... B32B 15/00

[52] U.S. Cl. ..... 428/626; 428/680

[58] Field of Search ..... 428/680, 648, 428/621, 935, 936, 624, 626, 675

[56] References Cited

U.S. PATENT DOCUMENTS

| | | | |
|---|---|---|---|
| 2,926,124 | 2/1960 | Taylor et al. | 428/675 |
| 3,355,267 | 11/1967 | Du Rose | 428/675 |
| 3,681,209 | 8/1972 | Campbell et al. | 428/680 |
| 4,049,508 | 9/1977 | Morrissey | 205/252 |
| 4,082,623 | 4/1978 | Musbach | 205/252 |
| 4,554,219 | 11/1985 | Gamblin | 428/680 |
| 4,560,623 | 12/1985 | Iwata et al. | 428/680 |

*Primary Examiner*—John Zimmerman

*Attorney, Agent, or Firm*—Wood, Phillips, VanSanten, Clark & Mortimer

[57] ABSTRACT

Fasteners which are nonallergenic and permit magnetic detection of lost or broken needles in the clothing on which they are used, comprising a fastener body, an undercoat of nonmagnetic Ni—P alloy plating, and a top layer of nonmagnetic Ni—Sn alloy plating. The compositional ratio by weight of the Ni—Sn alloy is in the range of Sn:Ni= 1:2.2~2.8.

3 Claims, No Drawings

NI-SN PLATED FASTENERS FOR CLOTHING

BACKGROUND OF THE INVENTION

This invention relates to nickel-tin alloy-plated fasteners, provides various properties for achieving the objects of the invention of plastics or nonmagnetic metals for use with clothing and the like, and more specifically to plastic or nonmagnetic metal fasteners plated first with a nickel-phosphorus alloy and then with a nickel-tin alloy.

While various metals are used in plating buttons and other fasteners such as metal snaps for use on clothes, nonmagnetic Ni—P alloys have predominantly been used for infant clothes and the like to permit magnetic detection of lost or broken needles in the products. Nonmagnetic as it is, Ni—P alloy plating can pose a problem of inducing allergy to the human skin exposed to the plated objects.

SUMMARY OF THE INVENTION

It is therefore a principal object of this invention to provide snap fasteners and the like plated with substances that rarely induce human allergy while retaining the conventional merits of plating (nonmagnetic property, fine tinge, and slight possibility of tarnishing). After a search for such substances it has now been found that all the properties that permit the achievement of the object of the present invention are obtained with duplex plating, consisting of an Ni—P undercoat and an Ni—Sn alloy layer. The Ni—P alloy is a classic plating substance but is not frequently employed for general purposes. The present invention found that a two ply plating of Ni—P undercoat plus a Ni—Sn top layer, which has never been used in plating buttons and other fasteners. The Ni—P alloy layer as an undercoat can be formed by electroplating or electroless plating. The former process is applicable to metal fasteners and the latter to both metal and plastic ones. The Ni—Sn alloy plating may be performed by either process.

DETAILED DESCRIPTION OF THE INVENTION

The present invention will now be described as embodied in brass buttons or fasteners plated first with an Ni—P alloy and then with an Ni—Sn alloy by ordinary electroless plating (Ni—P plus Ni—Sn, hereinafter abbreviated as NNS). Attempts were made to coat such fasteners with only the Ni—Sn alloy, but they failed because Ni deposited too scarcely to form an appropriately thick layer. That is why the Ni—Sn alloy plating is preceded by the Ni—P alloy plating.

The NNS plating is conducted, for example, by the following sequence of steps:

| | |
|---|---|
| 1. Immersion degreasing | 10 min. |
| Water rinsing | 3 times |
| 2. Electrolytic degreasing | 10 min. |
| Water rinsing | 3 times |
| 3. Acid activation | 30 sec. |
| Water rinsing | 2 times |
| 4. Ni—P alloy plating | 60~100 min. |
| Water rinsing | 3 times |
| 5. Acid activation | 30 sec. |
| Water rinsing | 2 times |
| 6. Ni—Sn alloy plating | 15 min. |
| Water rinsing | 2 times |
| 7. Drying | |

The composition of Sn and Ni suited for the present invention, in terms of the ratio by weight of the metals, is preferably in the range of Sn:Ni=1:2.2~2.8. This range makes the alloy nonmagnetic and nonallergenic. If the Ni content is too small the alloy is so hard that it adheres poorly to the undercoat and tends to crack. This combines with a blackish tinge to diminish the marketability of the plated product. Conversely, too much Ni softens the alloy, making it susceptible to scratches.

Diverse tests were made to see if the NNS-plated goods retain the ordinary merits (e.g., nonmagnetic property and slight possibility of tarnishing). The results will be discussed below. The composition of the Ni—P plating as the undercoat was adjusted to Ni:P=9:1 and that of the Ni—Sn plating was always in the range of Sn:Ni=1:2.2~2.8.

Tests on resistance to corrosive attack of household detergents (containing bleaching agents)

First, the results of corrosion resistance tests conducted with household detergents (containing bleaching agents) will be explained. For the tests a total of 35 different household detergents each containing a fragrant bath additive at the rate of 100 milligrams per liter were used. Each detergent was dissolved in water at a concentration 3 times that of a standard bath, and Ni—P-plated and NNS-plated snap fasteners were immersed in the bath at 40° C. and then allowed to stand for 72 hours. In every bath of those detergents the snap fasteners did not tarnish for the first 24-hour period. After the lapse of 72 hours, the Ni—P-plated fasteners were found tarnished with 9 detergents, whereas the NNS-plated fasteners remained untarnished with all the 35 detergents.

Separately, the snap fasteners were placed into baths at 40° C. of 5 different detergents each at a concentration 5 times the standard and kept immersed for 216 hours (9 full days). All the Ni—P-plated fasteners tarnished but the NNS-plated were not.

Also, as monitorial test 79 families were asked to wash test pieces of cloth fitted with NNS-plated fasteners 35 times at their houses. Out of the 79 families 3 reported tarnishing, but the changes were rather inconspicuous and no tear or break took place. Although 5 monitors used detergents with a fragrant bath additive, no NNS-plated fasteners underwent discoloration upon the washes.

Further, pieces of cloth with Ni—P- and NNS-plated snap fasteners were placed in baths at 40° C. of detergents for immersion (or diaper) washing, each of which contained a bath additive and was concentrated to 3 times the standard concentration, and kept immersed for 24 hours. The Ni—P-plated fasteners tarnished but the NNS-plated ones did not.

Reactive dye resistance test

Ni—P-plated and NNS-plated snap fasteners were sewn on opposite sides of a piece of cloth dyed with a reactive dye. The cloth was soaked in city water, sealed in a vinyl pouch, and kept in a thermostatic chamber at 60° C. for 48 hours. The Ni—P-plated fasteners tarnished noticeably but the NNS-plated ones did only slightly.

Chemical resistance tests

Test pieces of bleached cloth carrying Ni—P-plated and NNS-plated snap fasteners on opposite sides were impregnated, one for each, with 3% solutions of various chemicals (hydrochloric acid, nitric acid, sodium hydrogensulfite, acetic acid, formic acid, hydrosulfite, acrylic acid, sodium hypochlorite, formalin, sodium hydroxide, and perchloroethylene). The impregnated pieces were sealed in vinyl pouches and kept in a thermostatic chamber at 50° C. for 4 hours. With all the chemical solutions excepting that of sodium hydroxide, the NNS-plated fasteners were the same as or tarnished less than the Ni—P-plated ones.

Besides, the cloth pieces with the fasteners were immersed in other aqueous solutions of chemicals as follows:

Hydrogen peroxide (40 cc/l, 80° C., 20 min.)

Caustic soda (30 g/l, 90° C., 30 min.)

Acetic acid (5 cc/l, 30° C., 5 min.)

Hydrosulfite (40 g/l, 80° C., 20 min.)

Immersion in these solutions again caused less tarnishing of the NNS-plated fasteners than the Ni—P-plated.

Tests on resistance to manufacturers' (industrial) laundering

The NNS-plated snap fasteners resisted tarnishing with laundering of the clothing carrying them in varied ways, i.e., one-wash, bleach, stone wash, bio-wash, and chemical wash, by clothing manufacturers (Nissen, Koritsu, Kyowa, and Nishie Denim).

Magnetic test

Two groups of 20 snap fasteners each were tested on a lost-broken needle detector. Like the Ni—P-plated fasteners, the NNS-plated gave a value on the mere noise level.

Salt spray test

This test was performed generally in conformity with the testing procedure of JIS-Z-2371 under the following conditions:

NaCl 15% =pH 6.5~7.2

Test chamber temperature =35° C.

Air saturator temperature =47° C.

Spray pressure =1.0 kg/cm$^2$

Spray rate =1.0 ml/80 cm$^2$.hr

After spraying for 16 consecutive hours the test fasteners were allowed to stand in a test chamber for 8 hours. The NNS-plated fasteners showed nothing unusual.

Test for determining liberation of nickel (A Danish test for determining the liberation of nickel from "merchandise "obviously containing nickel)

Procedure:—The surface of test objects is rubbed in a prescribed manner with cotton gauze for 30 seconds. Two drops each of an alcohol solution of 1% dimethylglyoxime and an aqueous solution of 10% ammonium hydroxide are given to the gauze, and the gauze is inspected to see if it turns red.

The test showed that the Ni—P-plated snap fasteners caused color development at the rate of once in 10 test runs but the NNS-plated fasteners did not produce color over more than 10 runs. This indicates that the latter inhibits the allergic reaction of the human skin that can take place upon exposure to the former.

The test results as described above have revealed that NNS-plated snap fasteners achieve the effect of inhibiting the allergy of the human skin to metals, thus attaining the primary object of the present invention. It has also been found that the NNS plating maintains or improves the merits of ordinary Ni—P plating, that is, nonmagnetic property, tarnishing resistance, and chemical resistance. Another surprising effect found is that the cloth with NNS-plated fasteners does not tear easily upon bleaching.

Thus, the NNS plating according to the present invention has now made it possible to provide metal fasteners such as snaps and buttons plated with a substance that rarely induces human allergy, the principal object of the invention, while retaining or even enhancing the advantages of the conventional Ni—P plating.

While there has been described what is at present considered to be a preferred embodiment of the invention, it will be obvious to those skilled in the art that various changes and modifications may be made without departing from the invention in its broader aspects, and it is intended that the appended claims cover all such changes and modifications as falling within the spirit and scope of the invention.

What is claimed is:

1. A substantially nonallergenic and nonmagnetic fastener for clothing that permits magnetic detection of metallic objects such as needles in the clothing, the fastener comprising:

a fastener body;

an undercoat of nonmagnetic nickel-phosphorus alloy plating on the fastener body, said nickel-phosphorus alloy having a nickel-phosphorus weight ratio of 9:1; and a top layer of nonmagnetic, nonallergenic nickel-tin alloy plating, said nickel-tin alloy having a tin:nickel weight ratio in the range of 1:2.2 to 1:2.8, the undercoating being present in a thickness effective to permit the top layer to have a thickness effective to inhibit an allergic reaction due to the undercoating.

2. The fastener of claim 1 wherein the effective thickness of the undercoat is a thickness obtained by exposure for a time period in the range of 60 to 100 minutes to a nickel-phosphorus plating composition.

3. The fastener of claim 1 wherein the effective thickness of the top layer is a thickness obtained by exposure for a time period of about 15 minutes to a nickel-tin plating composition.

* * * * *